US005802787A

United States Patent [19]

Thaler

[11] Patent Number: 5,802,787

[45] Date of Patent: Sep. 8, 1998

[54] GROMMET SEAL FOR ROOF FLASHING

[76] Inventor: Ken Thaler, 32-33 Maple Wood Drive, R.R. #1, Parry Sound, Ontario, Canada, P2A 2W7

[21] Appl. No.: 800,218

[22] Filed: Feb. 12, 1997

[51] Int. Cl.[6] ..... E04D 13/14

[52] U.S. Cl. ..... 52/219; 52/199; 285/42

[58] Field of Search ..... 52/198, 199, 218, 52/219; 285/42–44

[56] References Cited

U.S. PATENT DOCUMENTS 5,328,212 7/1994 Kosik, Jr. et al. ..... 285/42

*Primary Examiner*—Creighton Smith

*Attorney, Agent, or Firm*—Mark Kusner

[57] ABSTRACT

The invention provides a resilient grommet of homogeneous elastomeric material for forming a flexible seal enveloping a top portion of a roof flashing and sealing a coaxially disposed member projecting through an open top portion of the roof flashing defining a gap therebetween, the flashing including an outwardly extending flange adjacent the open top portion thereof, the grommet comprising: a grommet body disposed about the top portion of the flashing and substantially covering the gap; mounting means for resiliently mounting an interior surface of the body about the flange of the flashing; and sealing lip means extending inwardly from a top portion of the body for resiliently sealingly engaging an exterior surface of the projecting member.

18 Claims, 3 Drawing Sheets

GROMMET SEAL FOR ROOF FLASHING

TECHNICAL FIELD

The invention is directed to a resilient grommet of homogeneous elastomeric material for forming a flexible seal enveloping the top portion of a roof flashing and sealing about a coaxially disposed member projecting through the roof flashing.

BACKGROUND OF THE ART

Roof flashing is used to provide a weatherproof seal around pipes, stacks, and other members projecting through a roof. The flashing is generally sheet metal or flexible molded rubber formed in the appropriate shape to encircle such projecting members.

The sealing of the gap between the flashing and the projecting member presents several problems. It is obviously very critical to provide a long lasting watertight seal to prevent water infiltration and damage to the building interior. Many means have been used with varying degrees of success.

A flexible material such as bitumen or caulking is commonly used as a sealant since the gap is often irregular in shape and an allowance for differential expansion and contraction must be provided between the flashing and member. For example, stacks which exhaust hot gases, hot water pipes, air conditioning pipes etc. which project through the roof may expand and contract significantly relative to the flashing.

A common method is to form flashing into a pitch pot around tile projecting member and then fill the pot with hot liquid bitumen. This conventional method is increasingly falling from favour since the pool of hardened pitch often cracks with repeated freeze thaw cycles, the end result is unsightly, and repairs are frequent.

A preferred modern installation includes a prefabricated metal flashing with a resilient elastomeric sealing gasket or grommet at the top of the flashing. Several prior art grommets require specially manufactured flashing to mate with or house the specially designed grommet.

For example, U.S. Pat. No. 4,010,578 to Logsdon provides a metal flashing with a convex annular recess to house an annular sealing grommet. U.S. Pat. No. 4,265,058 also to Logsdon provides a sheet metal skirt on the flashing to interlock with an integrally formed resilient seal. U.S. Pat. No. 5,237,789 to Thaler, the present inventor, shows an annular grommet with an outer slit secured to an inwardly facing flange on the flashing.

In such prior art grommets, it is critical to ensure that the grommet is properly fitted during installation and remains in place. Improper installation or accidental dislodging of the sealing grommet ruins the waterproof seal and could result in significant damage. To prevent this problem, U.S. Pat. No. 4,265,058 to Logsdon forms the elastomeric seal integrally with a perforated metal skirt on the flashing.

U.S. Pat. No. 5,237,789 to Thaler, the present inventor, provides an internal ring of spring steel to force the grommet outwardly into sealing engagement on the sheet metal flange of the flashing. Difficulties arise if the steel spring corrodes or is dislodged during installation.

The outer surface of prior art grommets and flashing are designed to shed precipitation. However discontinuities in the generally smooth outer surfaces caused by the transition between the grommet and flashing often result in moisture accumulation and ultimately penetration of the seal.

It is desirable therefore to produce a grommet for roof flashing which reliably sheds precipitation and retains a waterproof seal.

It is also desirable to provide a grommet which does not rely on metal springs which can be dislodged, or specialized complicated flashing designs.

DISCLOSURE OF THE INVENTION

The invention provides a novel resilient grommet for forming a flexible seal between roof flashing and a coaxially disposed member projecting through an open top portion of the roof flashing defining a gap therebetween, the flashing including an outwardly extending flange adjacent the open top portion thereof, the grommet comprising: a grommet body disposed about the top portion of the flashing and substantially covering the gap; mounting means for resiliently mounting an interior surface of the body about the flange of the flashing; and sealing lip means extending inwardly from a top portion of the body for resiliently sealingly engaging an exterior surface of the projecting member.

The novel grommet of the invention wraps around and resiliently seals around the outward portion of the flashing. The grommet forms a mushroom shaped head on the top of the flashing to effectively shed precipitation and avoid accumulation or pooling of water and ice on the flashing. The bottom portion of the grommet provides a rounded edge to collect and form droplets which are quickly shed from the assembly.

The grommet is formed of homogeneous elastomeric material which resiliently surrounds an outwardly extending flange on the flashing. The resilient grommet is stretched over the flange and snaps back into it's original shape when installed. The use of springs or specially formed housings of the prior art is eliminated. The grommet is easily positioned properly on the flange during installation and is not easily dislodged due to it's resilience and close fitting on the flange.

Further details of the invention and its advantages will be apparent from the detailed description and drawings included below.

BRIEF DESCRIPTION OF THE DRAWINGS

In order that the invention may be readily understood, a preferred embodiments of the invention will be described by way of example, with reference to the accompanying drawings wherein.

DETAILED DESCRIPTION OF PREFERRED EMBODIMENTS

Figure 2:
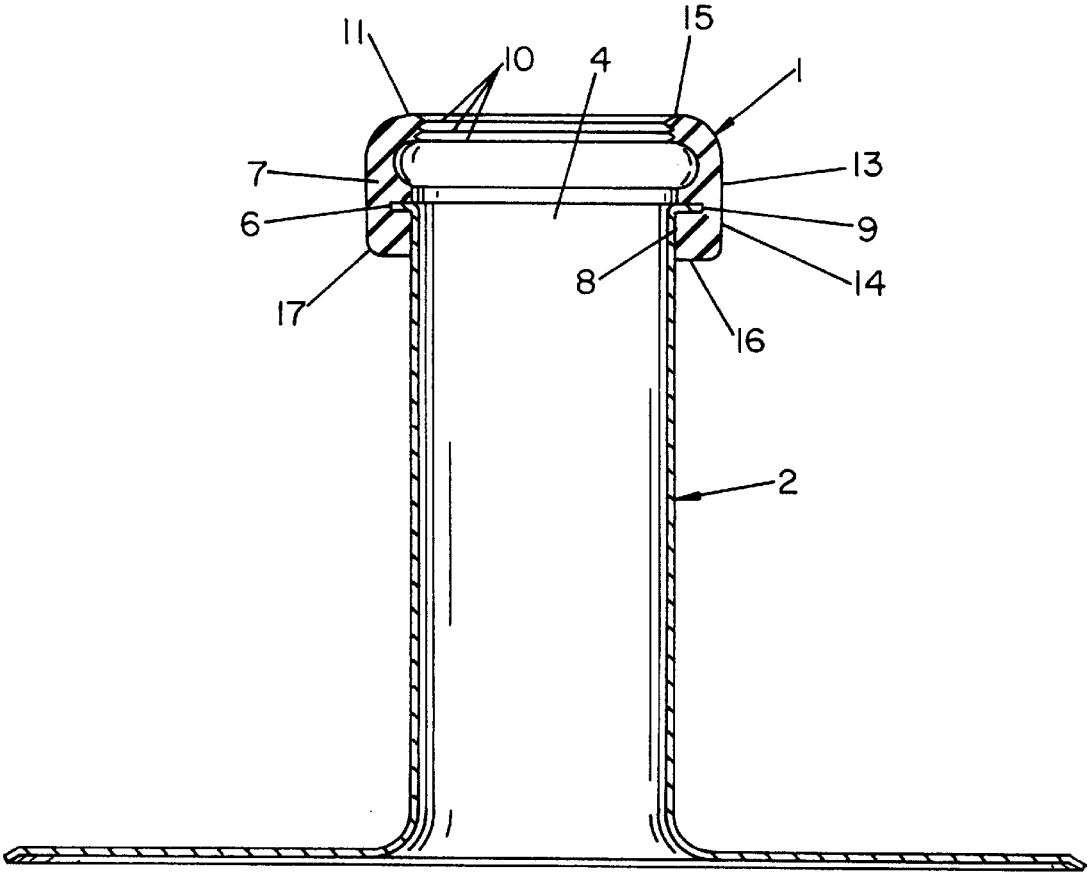
FIG. 2 is a longitudinal sectional view of the annular grommet of FIG. 1 mounted on the outwardly extending top flange of a cylindrical spun aluminium roof flashing.
Figure 3:
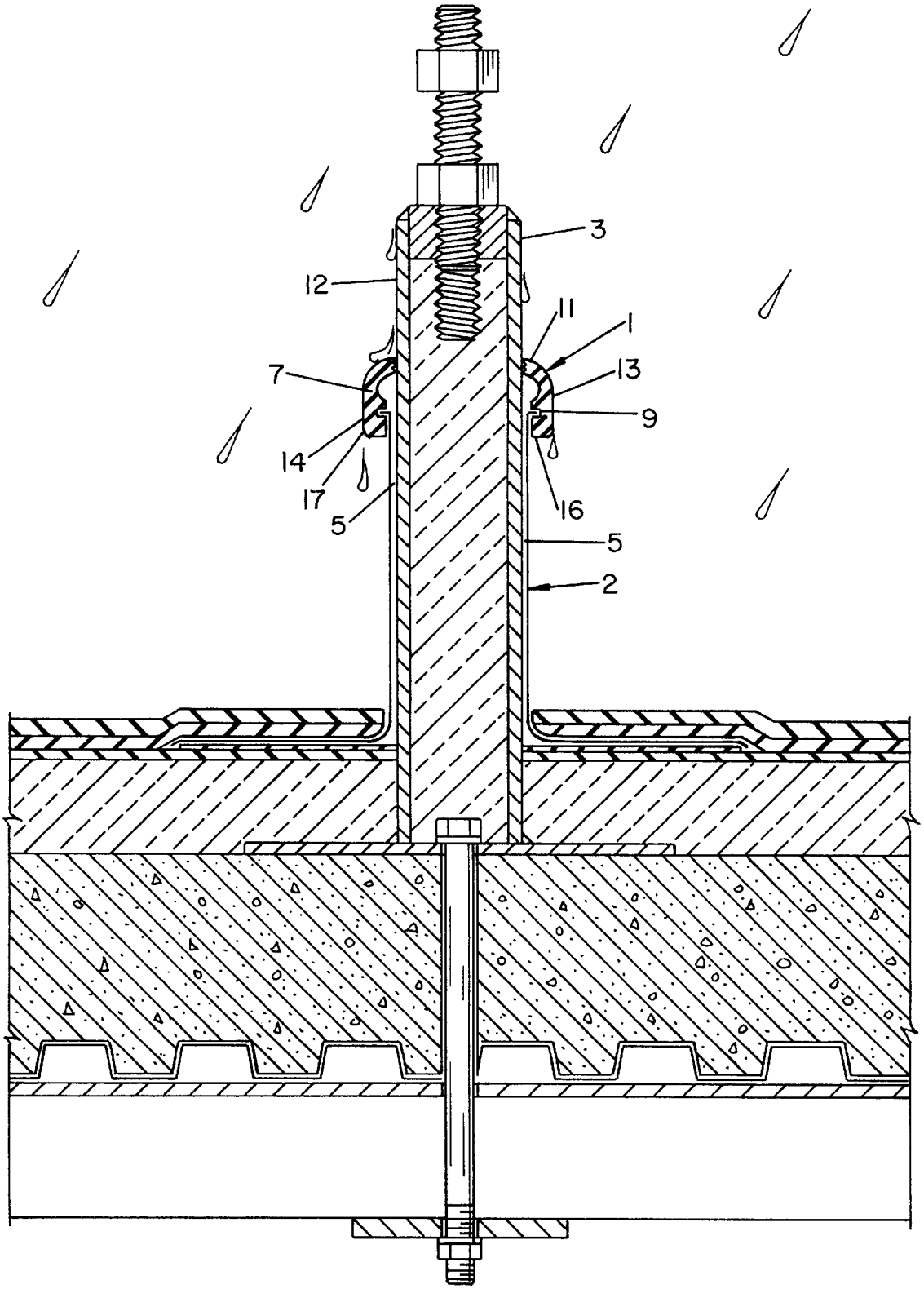
FIG. 3 is a longitudinal sectional view through a typical completed roofing installation showing the grommet sealing between the roof flashing and a projecting mechanical equipment roof support stand, as an example.
Figure 3A:
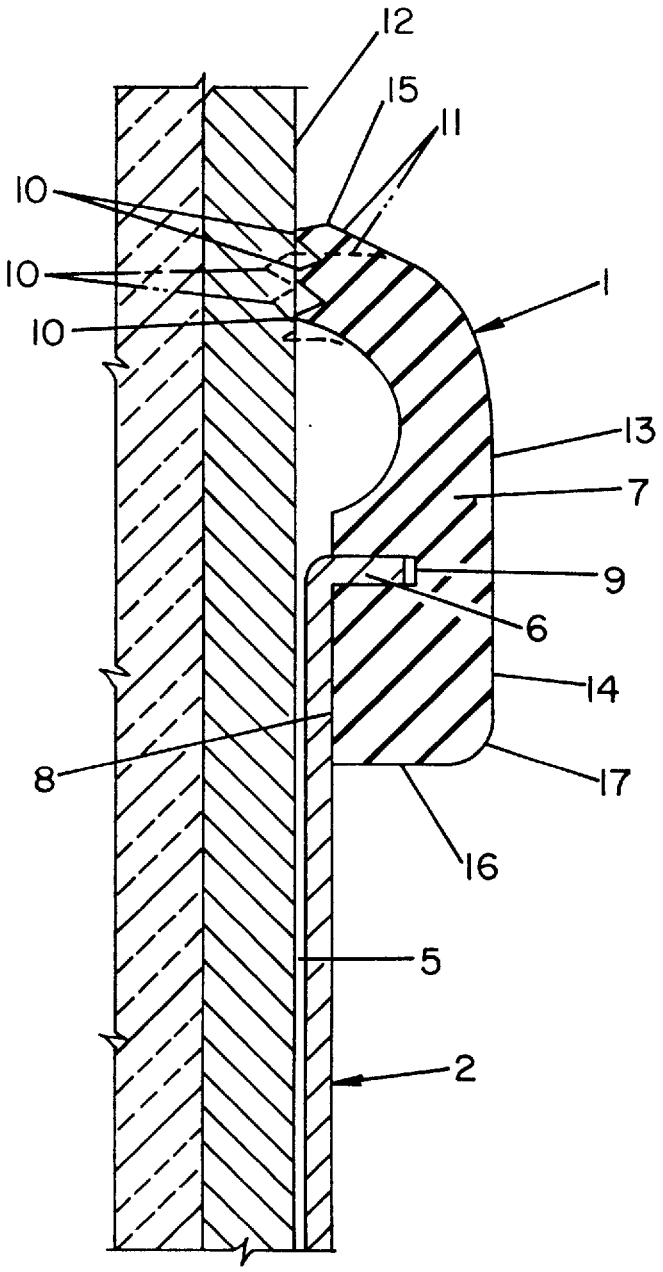
FIG. 3A is an enlarged view of area 3A of FIG. 3.

With reference to FIGS. 2 and 3, the preferred embodiment of the invention provides an annular resilient grommet 1 of homogeneous elastomeric material, although other grommet shapes and materials are within the contemplation of the invention.

The grommet 1 forms a flexible seal enveloping a top portion of a cylindrical sheet metal roof flashing 2. A coaxially disposed member 3, such as a pipe stand 3, projects through the open top portion 4 of the roof flashing 2. A gap 5 is defined between the flashing top portion 4 and the exterior surface of the projecting member 3.

The sheet metal flashing 2 includes an outwardly extending flange 6 adjacent the open top portion 4 of the flashing 2. The grommet 1, clearly shown in FIG. 1, has a generally annular cylindrical grommet body 7, In general, the body 7 is disposed about or envelops the entire top portion of the flashing 2. The grommet 1 substantially covers the gap 5 and shields the top of the flashing 2 from moisture penetration.

The grommet 1 includes mounting means for resiliently mounting an interior surface 8 of the body 7 about the flange 6 of the flashing 2. The grommet 1 is molded of homogeneous elastomeric material, such as rubber or polyurethane, and can be easily stretched by hand during installation to fit over the flange 6. As illustrated, the mounting means comprise a recess or rectilinear slit 9 formed on the interior surface of the grommet body 7. The interior diameter and dimensions of the slit 9 are selected to provide a snug resilient fit over the sheet metal flange 6 of the associated flashing 2. The close fitting cylindrical interior surface 8 of the grommet 1 also serves to securely mount the grommet 1 on the flashing 2 with a resilient clamping force. It will be understood that various different shapes of inwardly facing recesses 9 and mating outwardly facing flanges 6 are possible without departing from the scope of the invention.

At least one sealing lip 10 is provided, and preferably a plurality of inwardly tapered coaxial lips 10 disposed in a downwardly spaced apart array. As illustrated, three lips 10 are shown extending inwardly from a top portion 11 of the body for resiliently sealingly engaging an exterior surface 12 of the projecting member 3. To enhance the sealing properties of the grommet 1, a preferred arrangement includes an array of three lips with internal dimensions, or diameter as shown, of downwardly increasing magnitude.

Figure 1:
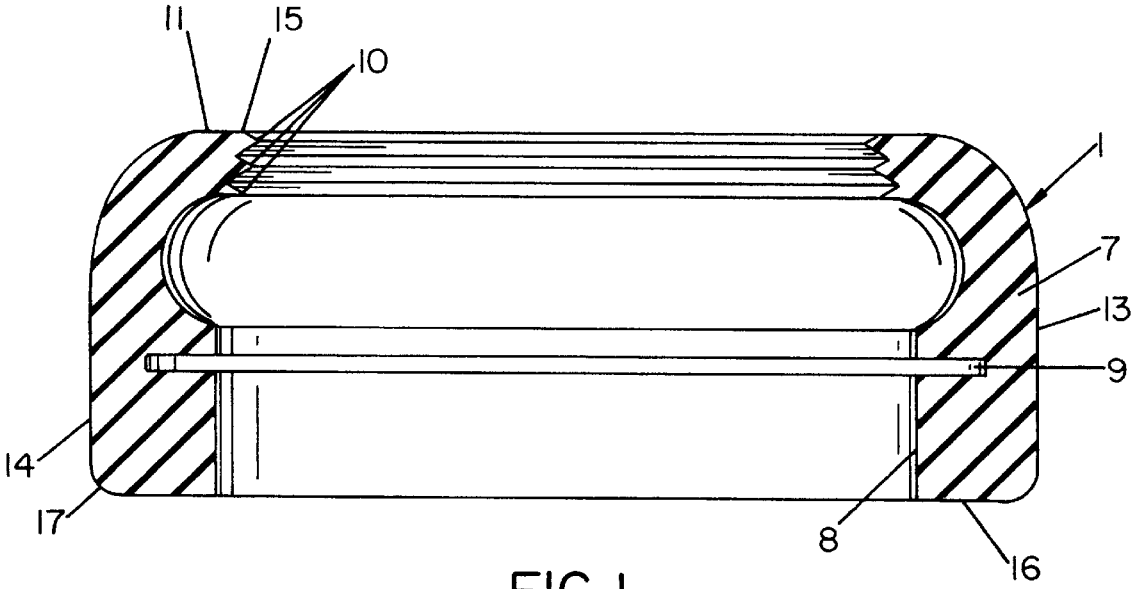
FIG. 1 is a longitudinal sectional view through an annular ring grommet embodiment of the invention.

As shown in detail in FIG. 1, the grommet 1 has a body 7 with a narrowed midportion 13 resiliently spanning between the mounting means 9 and the sealing lips 10. The illustrated midportion 13 has a concave internal surface which is relatively simple to mold in a partially toroidal profile. The lower portion 14 of the body 7 is firmly secured to the flashing 2 by the interlocking of the flange 6 and slit 9 as well as the close fit between the interior surface 8 of the grommet 1 and the exterior surface of the flashing 2.

The relatively narrow midportion 13 allows flexible movement of the sealing lips 10 relative to the fixed lower portion 14. During installation or differential expansion and contraction, the diameter of the lips 10 flexes, however, the arching midportion 13 can also flex longitudinally to provide superior sealing and compensate for relative movements.

As indicated in FIG. 3, the property of the grommet 1 to rapidly shed precipitation is an advantageous feature stemming from the complete envelopment of the top portion of the flashing 2. In general the grommet body 7 comprises an annular ring with sealing lips 10 disposed adjacent a top edge 15 of the grommet 1. To aid in shedding moisture from the top of the grommet 1, an external top portion 11 of the grommet body 7 arcuately convexly merges with the grommet midportion 13. The top portion 11 is shaped as a partial spheroid as shown in FIG. 1 but other shapes may be used to similar advantage.

To aid in shedding moisture from the lower portion 14 of the grommet 1, the body 7 includes a planar bottom surface 16 arcuately merging with the midportion 13. The lower edge 17 of the grommet 1 is rounded to aid in the formation of droplets which are then effectively shed as shown in FIG. 3. The exterior moisture cannot travel any significant distance upwardly around the flange 6 due to the close fit and sealing action of the grommet 1. The shedding of droplets at the lower edge 17 prevents moisture buildup and ensures the integrity of the seal.

Although the above description and accompanying drawings relate to specific preferred embodiments as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A grommet for sealing a gap defined between roof flashing and a coaxially disposed member projecting through an opening in an end of the roof flashing, the flashing including an outwardly extending flange adjacent the opening therein, the grommet comprising:

an annular grommet body formed of a resilient elastomeric material having an interior surface;

mounting means on said interior surface of the body dimensioned to receive and to encase a portion of the end of said roof flashing and form a seal therewith, said mounting means comprised of a recess in the interior surface of said body for receiving the flange of the flashing; and sealing lip means on said interior surface of said body, said lip means extending inwardly from a top portion of the body for receiving and resiliently sealingly engaging an exterior surface of the projecting member.

2. A grommet according to claim 1 wherein the lip means comprise a plurality of inwardly tapered coaxial lips disposed in a downwardly spaced apart array.

3. A grommet according to claim 2 wherein said array of lips have internal dimensions of downwardly increasing magnitude.

4. A grommet according to claim 3 having an array of three lips.

5. A grommet according to claim 1 wherein the body has a narrowed midportion resiliently spanning between the mounting means and the sealing lip means.

6. A grommet according to claim 5 wherein the midportion has a concave internal surface.

7. A grommet according to claim 6 wherein the concave internal surface has a partially toroidal profile.

8. A grommet according to claim 1 wherein the body comprises an annular ring with lip means disposed adjacent a top edge thereof.

9. A grommet according to claim 8 wherein an external top portion of the body arcuately merges with a midportion thereof.

10. A grommet according to claim 9 wherein the body includes a planar bottom surface arcuately merging with the midportion.

11. A resilient grommet for sealing a gap defined between roof flashing and a coaxially disposed member projecting through an opening in an end of the roof flashing, the flashing including an outwardly extending flange adjacent the opening therein, the grommet comprising:

an annular grommet body formed of a resilient, homogenous elastomeric material having an interior surface;

mounting means on said interior surface of the body dimensioned to receive and to encase a portion of the end of said roof flashing and form a seal therewith, said mounting means comprised a rectilinear slit in said interior surface of said body for receiving the flange of the flashing; and sealing lip means on said interior surface of said body, said lip means extending inwardly from a top portion of the body for receiving and resiliently sealingly engaging an exterior surface of the projecting member.

12. A roof flashing assembly comprising:

roof flashing means for surrounding a coaxially disposed member projecting through an open top portion of the roof flashing, the member and the roof flashing defining a gap therebetween, the flashing means including an outwardly extending flange adjacent the open top portion thereof;

a grommet having a grommet body dimensioned to receive a top portion of the flashing and to cover substantially the gap; the grommet body including an interior surface having mounting means resiliently engaging and forming a seal with the flange of the flashing and sealing lip means extending inwardly from said interior surface of the body for resiliently sealingly engaging an exterior surface of the projecting member.

13. A roof flashing assembly according to claim 12 wherein the grommet consists of homogenous elastomeric material, and the mounting means comprise a rectilinear slit in said interior surface of the body.

14. A roof flashing assembly according to claim 12 wherein the lip means comprise a plurality of inwardly tapered coaxial lips disposed in a downwardly spaced apart array, said array of lips having internal dimensions of downwardly increasing magnitude.

15. A roof flashing assembly according to claim 12 wherein the body has a narrowed midportion resiliently spanning between the mounting means and the sealing lip means.

16. A roof flashing assembly according to claim 12 wherein the body comprises an annular ring with lip means disposed adjacent a top edge thereof.

17. A roof flashing assembly according to claim 16 wherein an external top portion of the body arcuately merges with a midportion thereof.

18. A roof flashing assembly according to claim 17 wherein the body includes a planar bottom surface arcuately merging with the midportion.

* * * * *